US008925936B1

(12) United States Patent
Clos et al.

(10) Patent No.: US 8,925,936 B1
(45) Date of Patent: Jan. 6, 2015

(54) SKATEBOARD WITH ONE OR MORE USER MANEUVERABLE TRUCKS

(71) Applicants: Dave Clos, Howard Lake, MN (US); Craig Butturff, Howard Lake, MN (US); Craig Kjeldahl, Howard Lake, MN (US)

(72) Inventors: Dave Clos, Howard Lake, MN (US); Craig Butturff, Howard Lake, MN (US); Craig Kjeldahl, Howard Lake, MN (US)

( * ) Notice: Subject to any disclaimer, the term of this patent is extended or adjusted under 35 U.S.C. 154(b) by 33 days.

(21) Appl. No.: 13/845,010

(22) Filed: Mar. 17, 2013

(51) Int. Cl.
*A63C 17/01* (2006.01)

(52) U.S. Cl.
CPC ..... *A63C 17/012* (2013.01)
USPC ..... 280/87.042; 280/11.27

(58) Field of Classification Search
CPC ..... A63C 17/01; A63C 17/011; A63C 17/012
USPC ..... 280/11.27, 11.28, 809, 87.01, 87.021, 280/87.041, 87.042, 87.043
See application file for complete search history.

(56) References Cited

U.S. PATENT DOCUMENTS

| | | | | | |
|---|---|---|---|---|---|
| 3,069,182 | A * | 12/1962 | Hufford | ..... | 280/87.01 |
| 3,771,811 | A * | 11/1973 | Bueno | ..... | 280/87.042 |
| 4,160,554 | A * | 7/1979 | Cooney | ..... | 280/87.042 |
| 4,202,559 | A * | 5/1980 | Piazza, Jr. | ..... | 280/87.042 |
| 4,230,330 | A * | 10/1980 | Muhammad | ..... | 280/87.042 |
| 4,955,626 | A * | 9/1990 | Smith et al. | ..... | 280/87.042 |
| 6,511,083 | B1 * | 1/2003 | Tsai | ..... | 280/87.041 |
| 8,226,095 | B2 * | 7/2012 | Reyes, Jr. | ..... | 280/87.042 |
| 8,608,185 | B2 * | 12/2013 | Bermal | ..... | 280/87.042 |
| 2004/0104551 | A1 * | 6/2004 | Jacobs | ..... | 280/87.042 |
| 2004/0140633 | A1 * | 7/2004 | Beedle et al. | ..... | 280/11.27 |
| 2010/0044986 | A1 * | 2/2010 | Dannenberg | ..... | 280/87.042 |

* cited by examiner

*Primary Examiner* — John Walters
*Assistant Examiner* — Brian Swenson
(74) *Attorney, Agent, or Firm* — Dave Alan Lingbeck

(57) ABSTRACT

A skateboard with one or more user maneuverable trucks for a user to independently maneuver the trucks and wheels relative to the carriage platform. The skateboard with one or more user maneuverable trucks includes a support assembly including one or more truck and wheels being mounted upon said the one or more truck, and also includes a rotation assembly being in communication with the support assembly with one or more truck being rotatable therewith, and further includes a platform being in communication with the rotation assembly for supporting a user.

9 Claims, 4 Drawing Sheets

SKATEBOARD WITH ONE OR MORE USER MANEUVERABLE TRUCKS

BACKGROUND OF THE INVENTION

1. Field of the Invention

The present invention relates to skateboards and more particularly pertains to a new skateboard with one or more user maneuverable trucks for a user to independently maneuver the trucks and wheels relative to the carriage platform.

2. Description of the Prior Art

The use of skateboards is known in the prior art. More specifically, skateboards heretofore devised and utilized are known to consist basically of familiar, expected and obvious structural configurations, notwithstanding the myriad of designs encompassed by the prior art which have been developed for the fulfillment of countless objectives and requirements.

The prior art includes a skateboard which has a chassis, an axle and wheel assembly, and a board, with the board extending beyond one of the axles to provide an overhanging portion. The board may be rotatably mounted to the chassis, thus allowing the rider to spin in a circle while the skateboard is following a linear course. Another prior art includes an apparatus for a skateboard deck connected to a skateboard carriage by means of a rotative mechanism positioned between the deck and carriage. The carriage is comprised of a platform having the trucks and wheels mounted thereunder with fasteners fixedly positioning a bearing insert and carriage retaining ring to the top side of the platform. The deck has a friction ring fixed to the underside with fasteners passing through the deck and friction ring into the carriage retaining ring thereby enabling the deck to rotate relative to the carriage. Another prior art includes a cambered skateboard with a rigid track assembly conforming to curvature of the board at one or both ends. Provision is made for longitudinal adjustment of each truck mounted by the tracks. Yet, another prior art shows a platform being able to rotate relative to the board of a skateboard.

While these devices fulfill their respective, particular objectives and requirements, the aforementioned patents do not disclose a new skateboard with one or more user maneuverable trucks.

SUMMARY OF THE INVENTION

The general purpose of the present invention, which will be described subsequently in greater detail, is to provide a new skateboard with one or more user maneuverable trucks which has many of the advantages of the skateboards mentioned heretofore and many novel features that result in a new skateboard with one or more user maneuverable trucks which is not anticipated, rendered obvious, suggested, or even implied by any of the prior art skateboards, either alone or in any combination thereof. The present invention includes a support assembly including one or more truck and wheels being mounted upon said the one or more truck, and also includes a rotation assembly being in communication with the support assembly with one or more truck being rotatable therewith, and further includes a platform being in communication with the rotation assembly for supporting a user. None of the prior art includes the combination of the elements of the present invention.

There has thus been outlined, rather broadly, the more important features of the skateboard with one or more user maneuverable trucks in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new skateboard with one or more user maneuverable trucks which has many of the advantages of the skateboards mentioned heretofore and many novel features that result in a new skateboard with one or more user maneuverable trucks which is not anticipated, rendered obvious, suggested, or even implied by any of the prior art skateboards, either alone or in any combination thereof.

Still another object of the present invention is to provide a new skateboard with one or more user maneuverable trucks for a user to independently maneuver the trucks and wheels relative to the carriage platform.

Still yet another object of the present invention is to provide a new skateboard with one or more user maneuverable trucks that allows a user to maneuver and rotate each truck independently of one another while being on top of the skateboard.

Even still another object of the present invention is to provide a new skateboard with one or more user maneuverable trucks that allows a user to rotate each truck 360 degrees clockwise or counterclockwise as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
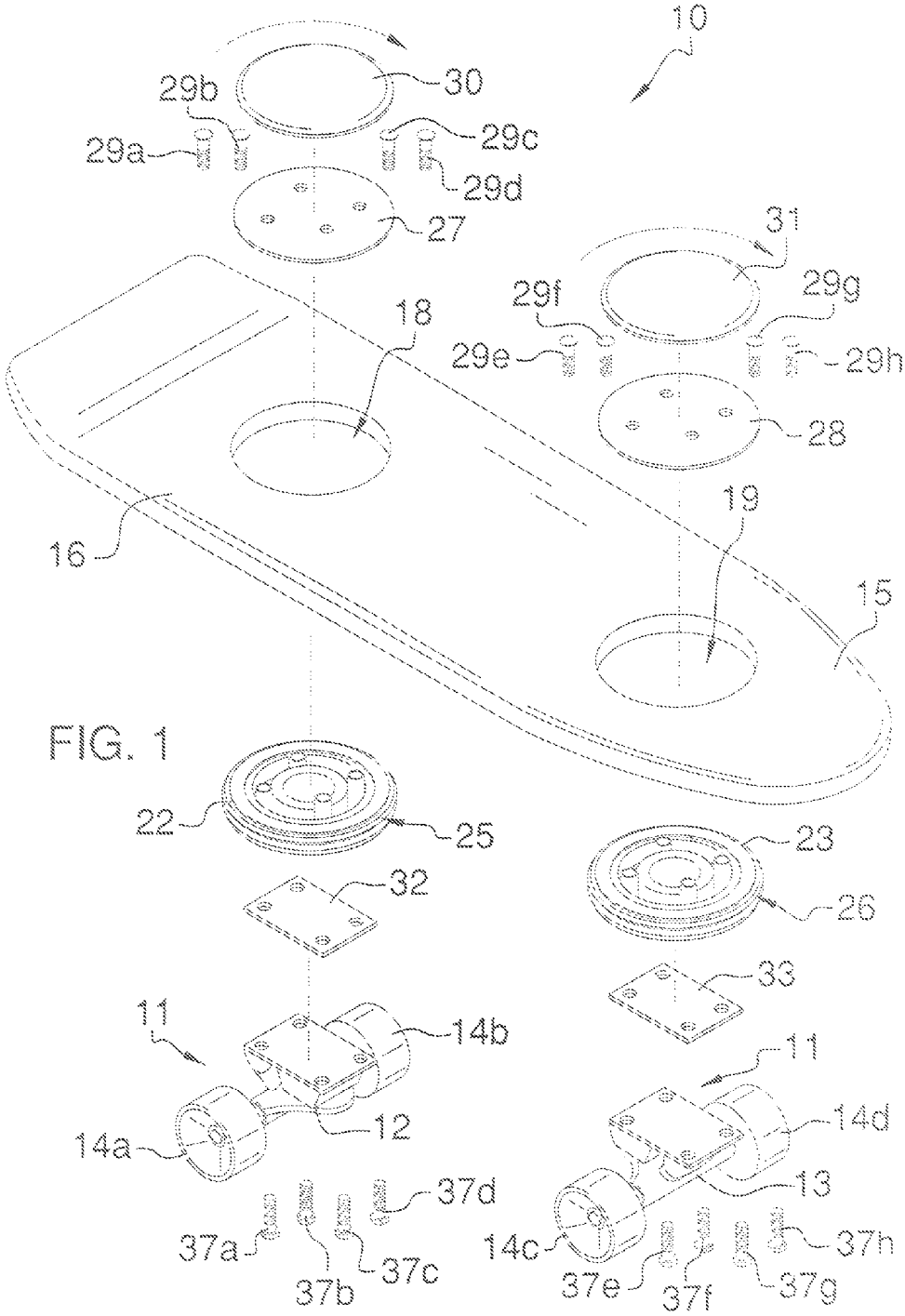
FIG. 1 is an exploded top perspective view of one embodiment of a new skateboard with one or more user maneuverable trucks according to the present invention.
Figure 2:
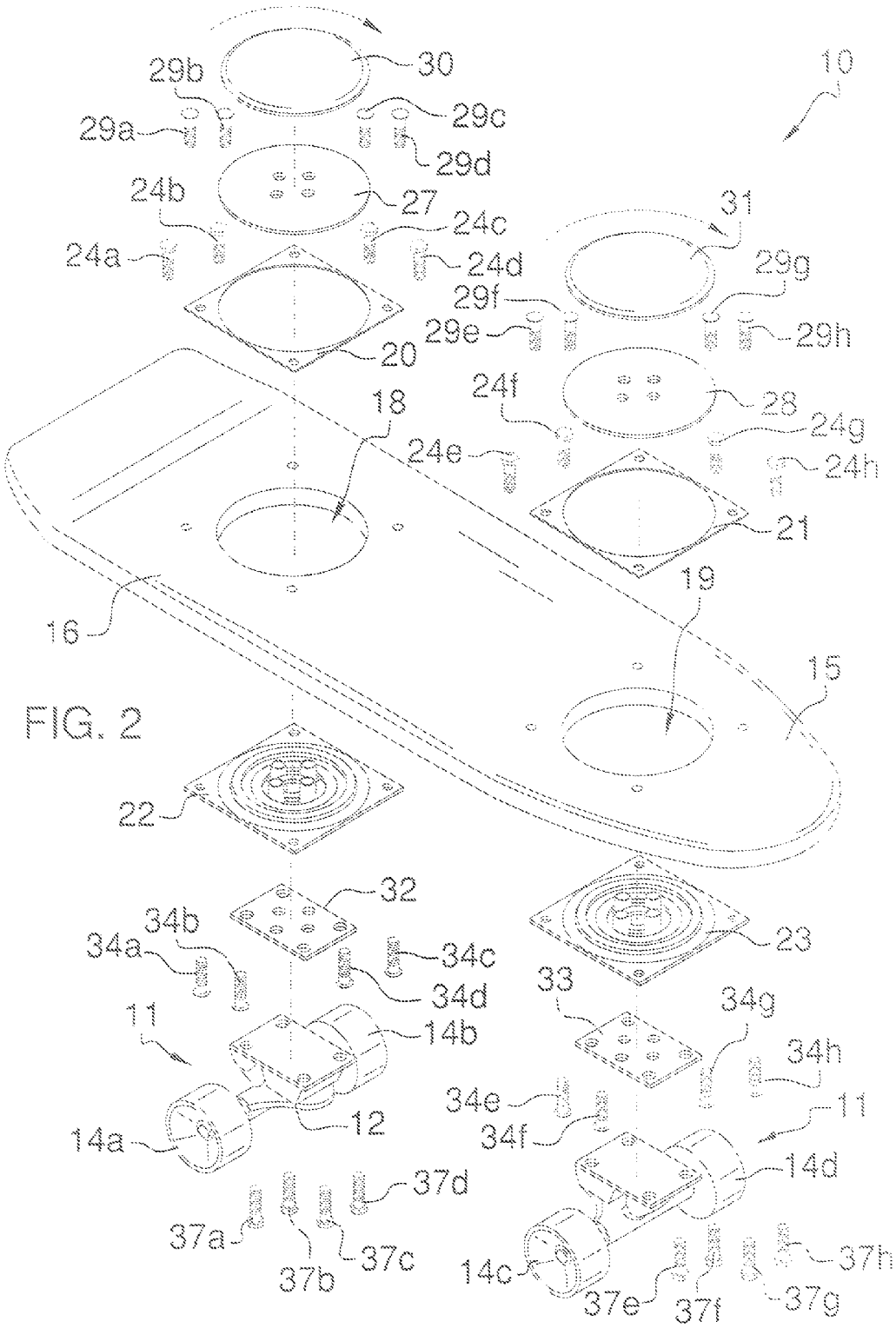
FIG. 2 is an exploded top perspective view of another embodiment of the present invention.
Figure 3:
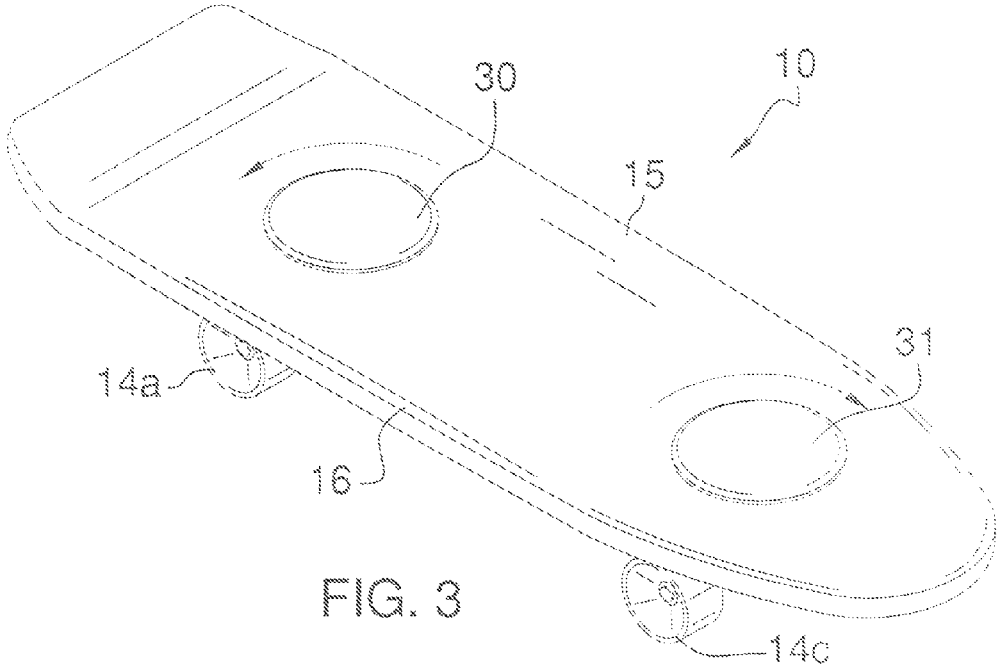
FIG. 3 is a top perspective view of the present invention.
Figure 4:
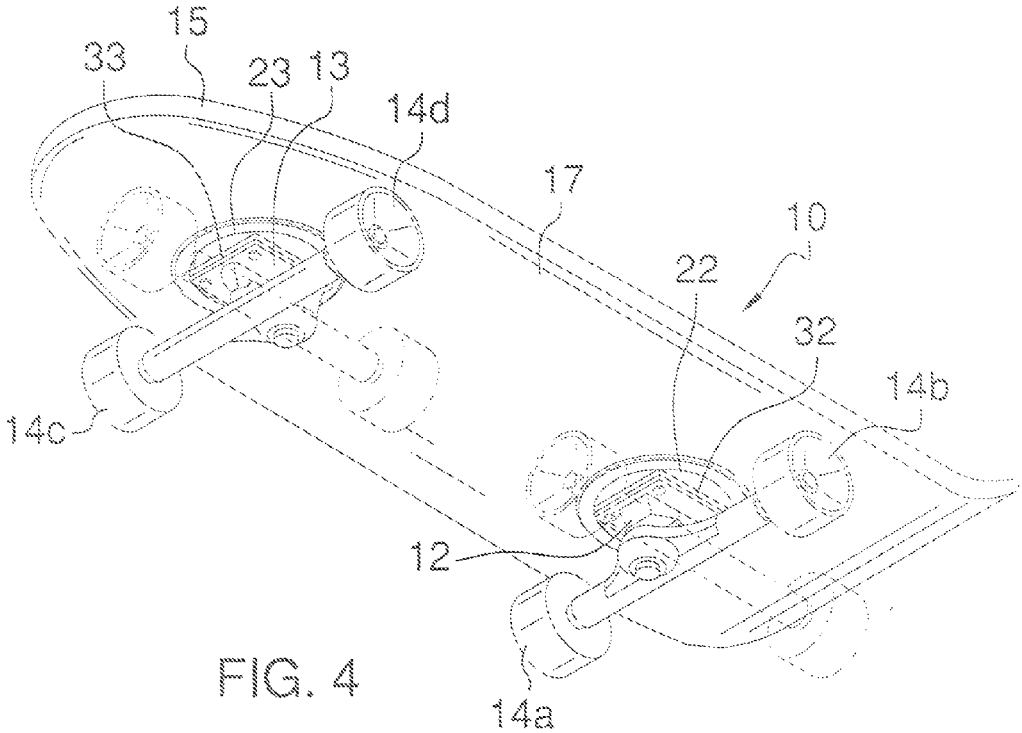
FIG. 4 is a bottom perspective view of the present invention.
Figure 5:
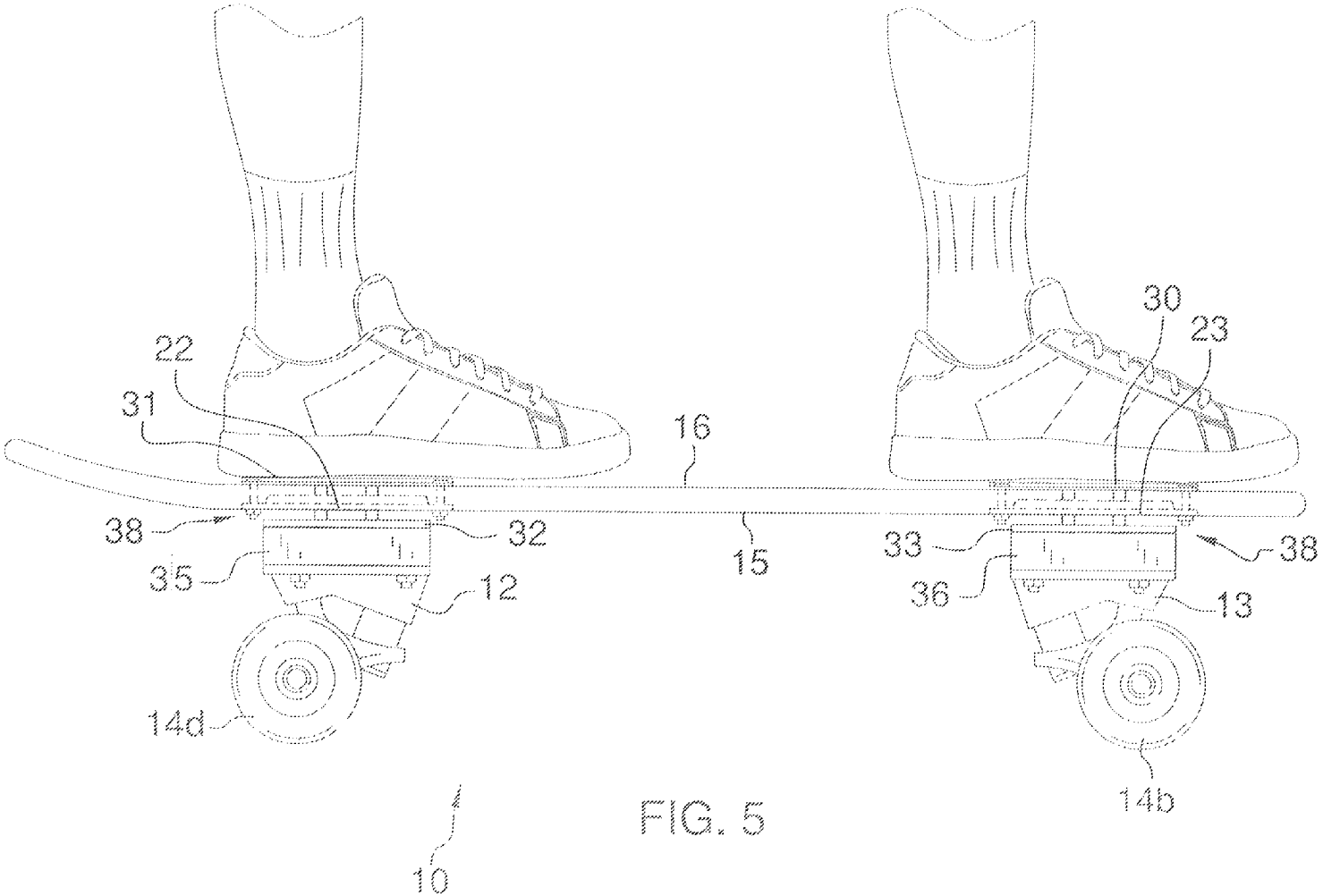
FIG. 5 is a side elevation view the other embodiment of the present invention

With reference now to the drawings, and in particular to FIGS. 1 through 5 thereof, a new skateboard with one or more user maneuverable trucks embodying the principles and concepts of the present invention and generally designated by the reference numeral 10 will be described.

As best illustrated in FIGS. 1 through 5, the skateboard with one or more user maneuverable trucks 10 generally comprises a support assembly 11 including one or more trucks 12,13 and wheels 14*a-d* being conventionally mounted upon at least one axle which is conventionally attached to the one or more trucks 12,13, and also comprises a rotation assembly 38 being in communication with the support assembly 11 with one or more trucks 12,13 being rotatable therewith, and a platform 15 being in communication with the rotation assembly 38 for supporting a user thereupon.

For one or more trucks 12,13, there may be just one truck 12 having a top planar portion and there may be a platform 15 with an opening 18 disposed through the platform 15. The rotation assembly 38 with the one truck 12 includes a bearing support member 20 being conventionally disposed at and aligned with the opening 18, and also includes a bearing member 22 having an outer race and an inner race being rotatable relative to the outer race with the bearing member 22 being conventionally retained by the bearing support member 20. As one embodiment, the bearing support member 20 is a planar member having an opening extending therethrough and having holes for receiving fasteners 24*a-d* being spacedly disposed along a perimeter. The planar member 20 is conventionally and securely supported upon the top 16 of the platform 15 at the opening 18 in the platform 15 with the opening of the planar member 20 having an axis which is aligned with an axis of the opening 18 in the platform 15. The bearing member 22 has holes disposed therethrough along a perimeter and also has threaded receivers extending through the inner race and is in contact to a bottom 17 of the platform 15 at the opening 18 and is fastened with fasteners 24*a-d* to the platform 15 and to the bearing support member 20 though the holes in the bearing support member 20 and through the holes in the bearing member 22. The bearing member 22 has an axis which is aligned with the axis of the opening 18 in the platform 15.

As another embodiment, the bearing support member 20 is a housing having a circumferential groove 25 and being securely seated and retained in the opening 18 of the platform 15 with the circumferential groove 25 being engaged with a side wall forming the opening 18. The housing 20 is substantially flush with the top 16 and bottom 17 of the platform 15. The bearing member 22 is securely and conventionally retained within the housing 20.

The rotation assembly further includes a planar engagement support member 27 having holes extending therethrough and being fastened with fasteners 29*a-d* to the inner race of the bearing member 22 through the holes of the engagement support member 27 and received in the threaded receivers of the bearing member 22 for rotation therewith and further being disposed upon the platform 15 at the opening 18 with an axis of the engagement support member 27 being aligned with the axis of the opening 18 in the platform 15, and also includes a user engagement member 30 being conventionally disposed and retained upon the engagement support member 27. The user engagement member has at least an upper portion that extends upward beyond a top 16 of the platform 15 so that the user can engage the user engagement member 30 independently of the platform 15. The user engagement member 30 is maneuverable and rotatable relative to the platform 15 as desired by the user. The user engagement member 30 is a disc-shaped pad being easily accessed by the user upon the platform 15 and being rotatable to effectively rotate the truck 12 as desired by the user.

The rotation assembly 38 also includes a planar truck interface 32 having holes extending therethrough and fastened with fasteners 34*a-d* through the holes of the truck interface 32 and into the threaded receivers of the bearing member 22 and to the top planar portion of the truck 12 with the truck 12 being rotatable with the bearing member 22 and the user engagement member 30. The rotation assembly 38 may further include a block member 35 having a thickness and having bores extending therethrough and fastened with fasteners 37*a-d* through the bores and to the truck 12 and to the truck interface 32 with the truck 12 being in operational communication and controlled by the user engagement member 30 through the interconnections to the bearing member 22 as shown in the drawings.

For one or more trucks 12,13, there may be a pair of trucks 12,13, each having a top planar portion and they may have the platform 15 having a pair of openings 18,19 extending therethrough with the openings 18,19 being opposedly disposed near opposed ends of the platform 15. The rotation assembly 38 with the pair of trucks 12,13 includes bearing support members 20,21 each being disposed at and aligned with a respective opening 18,19 of the platform 15, and also includes bearing members 22,23 each being conventionally retained by a respective bearing support member 20,21. As one embodiment, each bearing support member 20,21 is a planar member having an opening disposed therethrough and having holes disposed along a perimeter. Each planar member 20,21 is conventionally supported upon the platform 15 at a respective opening 18,19 of the platform 15 with an axis of the opening in the planar member 20,21 being aligned with an axis of the respective opening 18,19 in the platform 15. ach bearing member 22,23 has holes extending therethrough along a perimeter and also has threaded receivers being disposed through the inner race and is in contact to the bottom 17 of the platform 15 at a respective opening 18,19 and is fastened with fasteners 24*a-h* to the platform and to a respective bearing support member 20,21 through the holes in the respective bearing support member 20,21 and through the holes in the bearing member 22,23. Each bearing member 22,23 has an axis which is aligned with an axis of a respective opening 18,19 of the platform 15.

As another embodiment, each bearing support member 20,21 is a housing having a circumferential groove 25,26 and being securely sealed and conventionally retained in the respective opening 18,19 of the platform 15 with the circumferential groove 25,26 being engaged with a side wall forming the respective opening 18,19. Each housing 20,21 is substantially flush to the bottom 17 and top 16 of the platform 15. Each bearing member 22,23 is securely and conventionally retained within a respective housing 20,21.

The rotation assembly 38 further includes planar engagement support members 27,28 having holes being disposed therethrough and being fastened with fasteners 29*a-h* to the inner races of the bearing members 22,23 through the holes of the engagement support members 27,28 and received in the threaded receivers of the bearing member 22 for rotation therewith and being disposed upon the platform 15 at the openings 18,19 with an axis of each engagement support member 27,28 being aligned with the axis of a respective opening 18,19 in the platform 15, and also includes user engagement members 30,31 each being conventionally disposed and retained upon a respective engagement support member 27,28 and extending upward beyond the top 16 of the platform 15 so that the user can engage the user engagement members 30,31 independently of the platform 15. Each user engagement member 30,31 is maneuverable and rotatable relative to the platform 15 to effectively rotate the respective truck 12,13 as desired by the user. Each user engagement member 30,31 is a disc-shaped pad being easily accessed by the user upon the platform 15 and being rotatable to effectively rotate the respective truck 12,13 as desired by the user.

The rotation assembly 38 also includes planar truck interfaces 32,33 each having holes being disposed therethrough and each being fastened with fasteners 34*a-h* to a respective bearing member 22,23 and to a top planar portion of a respective truck 12,13 through the holes and being received in the threaded receiver of the respective bearing member 22,23. The rotation assembly 38 may further include block members 35,36 each having a thickness and having bores being disposed therethrough and being fastened with fasteners 37*a-h* through the bores to a respective truck 12,13 and to a respective truck interface 32,33.

In use, the user rides upon the platform 15 and propels the skateboard 10 by using one's foot to push upon a ground and can maneuver the skateboard 10 freely by rotating one or more trucks 12,13 by the user engaging one or more user engagement members 30,31 which are operationally connected to the trucks 12,15 through the bearing members 22,23. The user can put his/her foot upon one or more user engagement members 30,31 and rotate the selected user engagement member 30,31 which effectively rotates the respective truck 12,13 relative to the platform 15 as desired by the user to maneuver the skateboard 10. The user can rotate the selected truck 12,13 360 degrees either clockwise or counterclockwise As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the skateboard with one or more user maneuverable trucks. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A skateboard with one or more user maneuverable trucks comprising:

a support assembly including at least one truck and wheels mounted upon said at least one truck;

a rotation assembly being in communication with said support assembly with said at least one truck being rotatable therewith; and a platform being in communication with said rotation assembly for supporting a user wherein said at least one truck includes a truck, and said platform has an opening extending therethrough, wherein said rotation assembly includes a bearing support member being disposed at and aligned with said opening, and also include a bearing member being retained by said bearing support member, wherein said rotation assembly further includes an engagement support member fastened to said bearing member for rotation therewith and disposed upon said platform at said opening, and also includes a user engagement member disposed upon said engagement support member and extending upward beyond a top of said platform and maneuverable and rotatable relative to said platform to rotate said truck as desired by the user.

2. The skateboard with one or more user maneuverable trucks as described in claim 1, wherein said user engagement member is a disc-shaped pad being easily accessible by the user upon said platform and being rotatable with said bearing member and effectively rotating said truck as desired by the user.

3. The skateboard with one or more user maneuverable trucks as described in claim 1, wherein said rotation assembly also includes a planar truck interface being fastened to said bearing member and to said truck.

4. The skateboard with one or more user maneuverable trucks as described in claim 1, wherein said rotation assembly also includes a planar truck interface being fastened to said bearing member, and further includes a block member having a thickness and being fastened to said truck and to said truck interface.

5. A skateboard with one or more user maneuverable trucks comprising:

a support assembly including at least one truck and wheels mounted upon said at least one truck;

a rotation assembly being in communication with said support assembly with said at least one truck being rotatable therewith; and a platform being in communication with said rotation assembly for supporting a user, wherein said at least one truck includes a pair of trucks, and said platform has a pair of openings disposed therethrough with said openings opposedly disposed near opposed ends of said platform, wherein said rotation assembly includes bearing support members each disposed at and aligned with a respective said opening of said platform, and also includes bearing members each connected to a respective said bearing support member, wherein said rotation assembly further includes engagement support members each fastened to a respective said bearing member and rotatable therewith and disposed upon said platform at said opening, and also includes user engagement members each disposed upon a respective said engagement support member and extending upward beyond a top of said platform and maneuverable and rotatable relative to said platform to rotate said truck as desired by the user.

6. The skateboard with one or more user maneuverable trucks as described in claim 5, wherein each said user engagement member is a disc-shaped pad being easily accessed by the user upon said platform and being rotatable and effectively rotating said truck as desired by the user.

7. The skateboard with one or more user maneuverable trucks as described in claim 5, wherein said rotation assembly also includes planar truck interfaces each being fastened to a respective said bearing member and to a respective said truck.

8. The skateboard with one or more user maneuverable trucks as described in claim 5, wherein said rotation assembly also includes planar truck interfaces each being fastened to a respective said bearing member, and further includes block members each having a thickness and being fastened to a respective said truck and to a respective said truck interface.

9. A method of independently maneuvering a truck of a skateboard comprises:

providing a skateboard having a truck, a rotational assembly for rotating the truck, a platform being supported by the rotation assembly, and a user engagement member being rotatably exposed upon the platform;

a user engaging the user engagement member while riding upon the platform; and a user rotating the user engagement member which also rotates the truck relative to the platform as desired by the user, wherein the user rotating the user engagement member includes the user rotating the user engagement member clockwise or counterclockwise 360 degrees independently of the platform with the user engagement member being in direct operational communication with the truck resulting in the truck being routed in correspondence to the rotation of the user engagement member.

* * * * *